US007967408B2

(12) United States Patent
Saga

(10) Patent No.: US 7,967,408 B2
(45) Date of Patent: Jun. 28, 2011

(54) PRINTER AND PRINTING METHOD

(75) Inventor: Kengo Saga, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 268 days.

(21) Appl. No.: 12/206,109

(22) Filed: Sep. 8, 2008

(65) Prior Publication Data

US 2009/0079779 A1 Mar. 26, 2009

(30) Foreign Application Priority Data

Sep. 20, 2007 (JP) ..... 2007-244369

(51) Int. Cl.
*B41J 29/38* (2006.01)
*B41J 15/10* (2006.01)

(52) U.S. Cl. ..... 347/14; 347/211

(58) Field of Classification Search ..... 347/14, 347/211

See application file for complete search history.

(56) References Cited

U.S. PATENT DOCUMENTS 6,259,868 B1 * 7/2001 Fujii et al. ..... 399/45
2005/0168559 A1 * 8/2005 LeVake et al. ..... 347/122

FOREIGN PATENT DOCUMENTS

JP 9-58034 3/1997

* cited by examiner

*Primary Examiner* — Julian D Huffman
(74) *Attorney, Agent, or Firm* — Patterson & Sheridan, LLP

(57) ABSTRACT

An aspect of the invention is a printer for printing on one surface and the other surface of a sheet-like printing medium fed in a predetermined feed direction. The printer includes, a first printing part for printing on the one surface, a second printing part provided on the upstream side of the first printing part for printing on the other surface, a storage area in which first image data and second image data are stored, and an adjustment part for adjusting printing start positions of printing operations performed by the first and second printing parts by shifting the readout order of the first image data to be stored in the storage area toward the end side in accordance with a positional difference between the first printing part and the second printing part in the feed direction.

4 Claims, 4 Drawing Sheets

PRINTER AND PRINTING METHOD

CROSS-REFERENCE TO RELATED APPLICATIONS

This application is based upon and claims the benefit of priority from prior Japanese Patent Application No. 2007-244369, filed Sep. 20, 2007, the entire contents of which are incorporated herein by reference.

BACKGROUND OF THE INVENTION

1. Field of the Invention

The present invention relates to a printer and a printing method and, more particularly, to a technique for printing both sides of a printing medium.

2. Description of the Related Art

As a printer for printing both sides of a printing medium, a thermal printer provided with first and second platen rollers, and first and second thermal heads opposed to the platen rollers, for printing front-back both sides of a printing medium such as thermal recording paper is proposed as is described in Jpn. Pat. Appln. KOKAI Publication No. 9-58034. In this thermal printer, the first and second platen rollers rotate in synchronization with each other, and feed the printing medium at the same feed rate. When the printing medium passes through a part between the first platen roller and the first thermal head, printing is performed by the first thermal head on one surface (for example, a front surface) thereof. When the printing medium passes through a part between the second platen roller and the second thermal head, printing is performed by the second thermal head on the other surface (for example, a back surface) thereof.

However, there is the following problem in the above-mentioned technique. That is, because of the structure of the printer, two thermal heads cannot be provided at the same position. Hence, when printing processing is started at the same time on the front and back surfaces of the printing medium, the printing start position differs between the front and back surfaces due to the difference in the position of the thermal head. In consideration of the above fact, there is proposed a printer in which timings of printing processing of both the thermal heads are adjusted in order to line up printing start positions on the front and back surfaces. However, in a printer in which timings of printing processing performed by a plurality of heads are adjusted, there is a problem that an algorithm of printing control becomes complicated.

Thus, in the present invention, an object thereof is to provide a printer and a printing method capable of lining up printing start positions on both surfaces of the printing medium by a simple algorithm.

BRIEF SUMMARY OF THE INVENTION

An aspect of the invention is a printer for printing on one surface and the other surface of a sheet-like printing medium fed in a predetermined feed direction, characterized by comprising a first printing part provided in the feed direction, for printing on the one surface, a second printing part provided on the downstream side of the first printing part in the feed direction, driven simultaneously with the first printing part, for printing on the other surface, a storage area in which first image data corresponding to the first printing part, and second image data corresponding to the second printing part are stored; and an adjustment part for adjusting printing start positions of printing operations performed by the first and second printing parts by shifting the readout order of the first image data to be stored in the storage area toward the end side in accordance with a positional difference between the first printing part and the second printing part in the feed direction.

An another aspect of the invention is a printing method for feeding a sheet-like printing medium in a predetermined feed direction, and performing printing processing on one surface and the other surface of the printing medium, comprising receiving first image data to be printed on the one surface, and second image data to be printed on the other surface; and adjusting printing start positions on the printing medium by shifting the readout order of the first image data to be stored in a storage area toward the end side in accordance with a positional difference in the feed direction between a first printing part provided in the feed direction, for printing on the one surface, and a second printing part provided on the downstream side of the first printing part in the feed direction, driven simultaneously with the first printing part, for printing on the other surface.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the detailed description of the embodiments given below, serve to explain the principles of the invention.

DETAILED DESCRIPTION OF THE INVENTION

Figure 1:
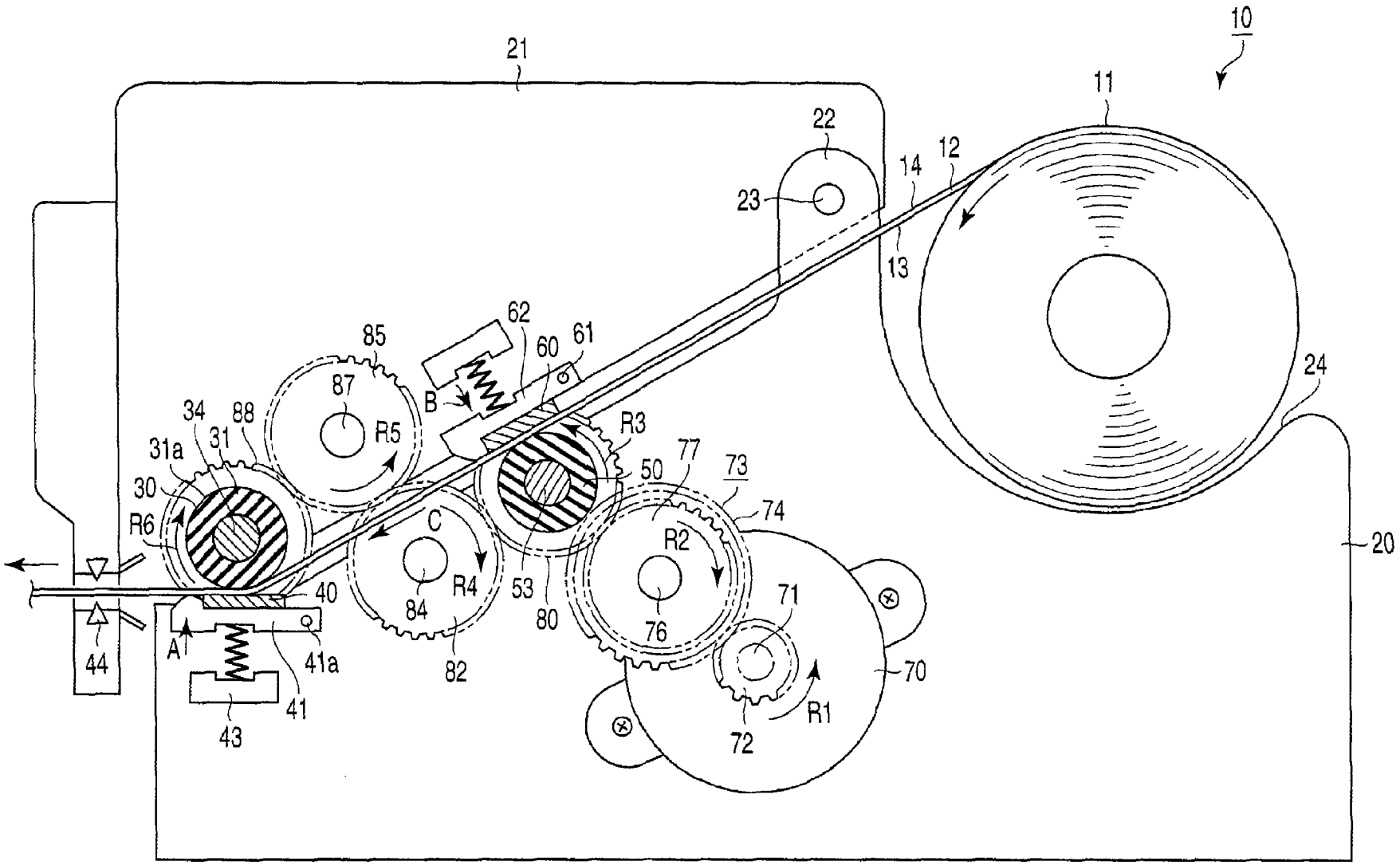
FIG. 1 is a side view showing the internal configuration of a thermal printer according to an embodiment of the present invention.
Figure 2:
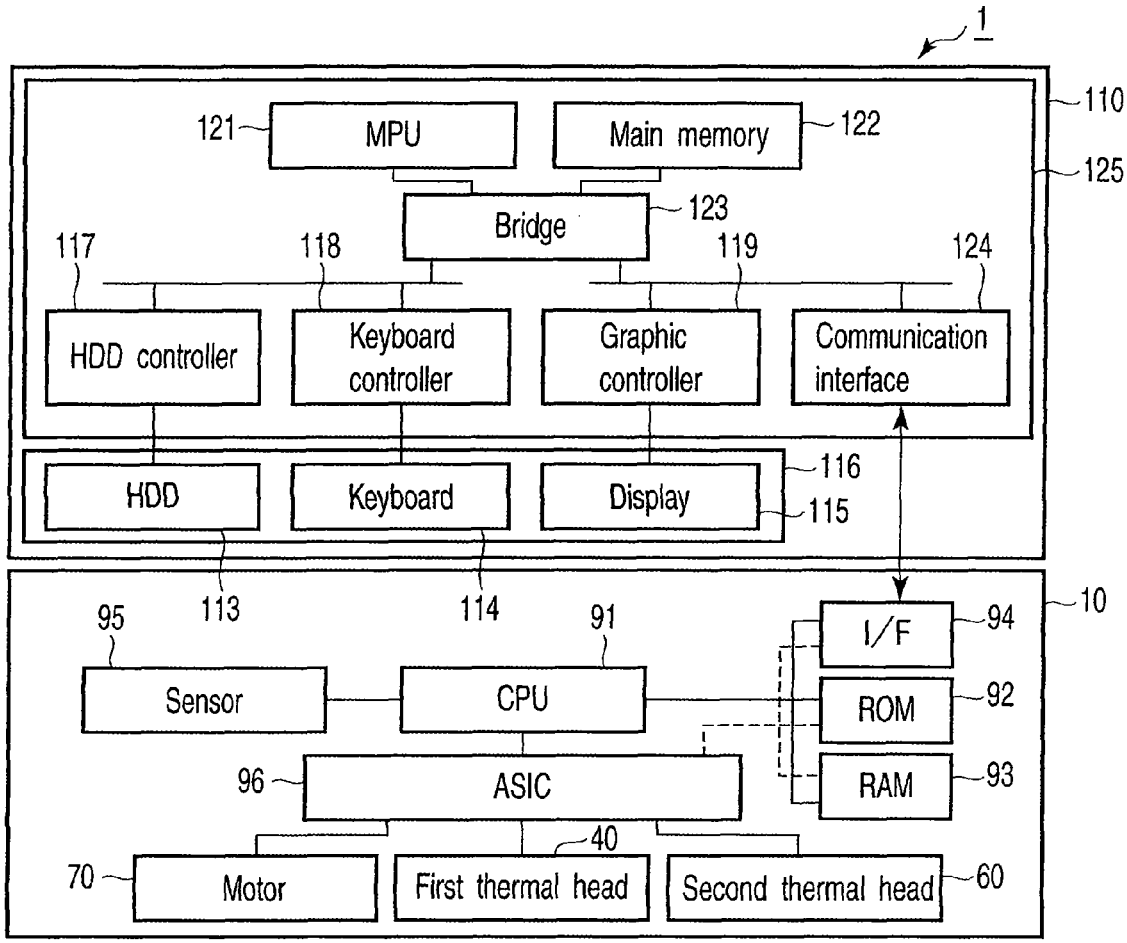
FIG. 2 is a block diagram showing the hardware configuration of a host computer and the thermal printer of the printer according to the embodiment of the present invention.
Figure 3:
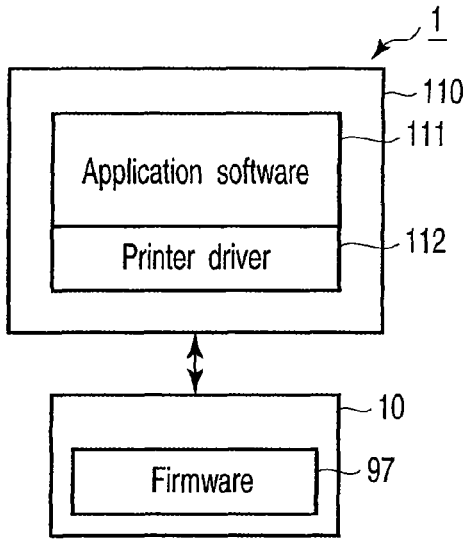
FIG. 3 is a block diagram showing the configuration of the printer.

A printer 1 according to an embodiment of the present invention will be described below with reference to FIGS. 1 to 3. FIG. 1 schematically shows the internal configuration of a thermal printer 10. FIG. 2 is a block diagram of a configuration example of the printer 1. FIG. 3 shows the hardware configuration of a host computer 110 and the thermal printer 10 of the printer 1. As shown in FIGS. 2 and 3, the printer 1 is constituted of the thermal printer 10, and the host computer 110 connected to the thermal printer 10.

The thermal printer 10 shown in FIG. 1 includes a printer main body 20, and a cover 21 which can be opened or closed. A paper containing section 24 is formed externally behind the printer main body 20, and thermal paper 11 serving as a printing medium is arranged in the paper containing section 24 in a state where the paper 11 is rolled up into a cylinder shape.

The thermal paper 11 includes base paper 12, and thermosensitive layers formed on the front and back surfaces of the base paper, and is formed into a sheet-like shape. A first thermosensitive layer is formed on one surface (for example, the front surface) 13 of the base paper, and a second thermosensitive layer is formed on the other surface (for example, the back surface) 14 of the base paper. These thermosensitive layers are constituted of a material which develops a desired color such as black or red when it is heated to a predetermined temperature or higher.

Printing processing of first image data 101 is performed on the one surface 13 by a first thermal head 40 as a first printing part, and printing processing of second image data 102 is performed on the other surface 14 by a second thermal head 60 as a second printing part. Incidentally, here, although the one surface 13 on which printing is performed by the first thermal head 40 on the downstream side is defined as the front surface, the front surface and the back surface may be reversed, and the order of printing processing is arbitrary.

A first platen roller 30 is provided to extend in the horizontal direction at a front end part of the cover 21. The first platen roller 30 is formed into a cylindrical shape, and includes a roller main body 31 constituted of a rubber elastic member such as nitrile rubber (NBR). The first platen roller 30 is attached to a first platen shaft 34 rotatably supported on the cover 21 through bearings, and is rotated around the first platen shaft 34 together with the first platen shaft 34.

The first thermal head 40 is provided at a front part inside the printer main body 20. The first thermal head 40 is arranged in a state where the thermal paper 11 is interposed between the head 40 and the first platen roller 30 in the closed state, and in a posture in which the head 40 is set sideways (almost horizontal) and upward so as to be opposed to the first platen roller 30. The first thermal head 40 is arranged at a downstream position in the paper feed direction (feed direction) indicated by an arrow C in FIG. 1 in which the thermal paper 11 is fed, in such a manner that the head 40 is in contact with the one surface 13 of the thermal paper 11, i.e., the first thermosensitive layer. The first thermal head 40 is attached to a heat sink 41 serving as a heat radiation member attached to the printer main body 20 to be rotatable around a shaft 41*a*. The center of the first thermal head 40 is pressed against the first platen roller 30 to be energized in the direction indicated by an arrow A in FIG. 1.

A second platen roller 50 is arranged at an upstream position of the first platen roller 30 in the paper feed direction, and at a rear part of the printer main body 20 to extend in the horizontal direction. The second platen roller 50 is attached to a second platen shaft 53 rotatably supported on the cover 21 through bearings. The second platen roller 50 is rotated around the second platen shaft 53 together with the second platen shaft 53.

The second thermal head 60 is arranged on the upstream side of the first thermal head 40 in the feed direction of the thermal paper 11. The second thermal head 60 is attached to a heat sink 62 serving as a heat radiation member attached to the cover 21 to be rotatable around a shaft 61. The second thermal head 60 is arranged above the second platen roller 50 in a state where the head 60 slopes from right to left. The second thermal head 60 is arranged to be opposed to the second platen roller 50 in a state where the cover 21 is closed, and the thermal paper 11 is interposed between the head 60 and roller 50. The second thermal head 60 is arranged in such a manner that the head 60 is in contact with the other surface 14 of the thermal paper 11, i.e., the second thermosensitive layer. The center of the second thermal head 60 is pressed against the second platen roller 50 to be energized in the direction indicated by an arrow B in FIG. 1.

A motor 70 serving as a drive part for rotating the first platen roller 30 and the second platen roller 50 is arranged at a lower position of the printer main body 20. An output gear 72 is attached to a rotating shaft 71 of the motor 70. The motor 70 is, for example, a stepping motor that can be rotated in the forward and reverse directions, and enables reverse feed. A power transmission mechanism 73 for transmitting the output power of the motor 70 to the first platen roller 30 and the second platen roller 50 includes a reduction gear 74, a drive gear 77, a second platen gear 80, idler gears 82 and 85, a first platen gear 88, and the like. The reduction gear 74 is provided in a state where the gear 74 is engaged with the output gear 72 of the motor 70. The reduction gear 74 is attached to a shaft 76 supported on the printer main body 20 through a bearing, and is rotated together with the shaft 76. The drive gear 77 integrally attached to the shaft 76 is provided adjacent to the reduction gear 74. The drive gear 77 is rotated together with the reduction gear 74 and the shaft 76. The second platen gear 80 is provided adjacent to the second platen roller 50 in a state where the gear 80 is engaged with the drive gear 77. The second platen gear 80 is fixed to the second platen shaft 53, and is made to be rotated together with the second platen shaft 53 and the second platen roller 50. The idler gear 82 is provided in front of and below the second platen gear 80 in a state where the gear 82 is engaged with the second platen gear 80. The idler gear 82 is attached to a shaft 84 supported on the printer main body 20 through a bearing, and is rotated together with the shaft 84.

The idler gear 85 to be engaged with the idler gear 82 in a state where the cover 21 is closed is provided in front of and above the idler gear 82. The idler gear 85 is attached to a shaft 87 rotatably supported on the cover 21 through a bearing, and is rotated together with the shaft 87. The first platen gear 88 to be engaged with the idler gear 85 is provided adjacent to the first platen roller 30. The first platen gear 88 is fixed to the first platen shaft 34, and is rotated together with the first platen shaft 34 and the first platen roller 30.

As described above, in the thermal printer 10 of this embodiment, the first thermal head 40, second platen roller 50, motor 70, second platen gear 80, and idler gear 82, and the like are arranged in the printer main body 20. On the other hand, the first platen roller 30, first platen gear 88, idler gear 85, second thermal head 60, and the like are arranged on the cover 21 side.

The thermal paper 11 formed into a cylinder shape, and contained in the paper containing section 24 obliquely passes the second thermal head 60 directed forward and downward, thereafter laterally passes the first thermal head 40 in the substantially horizontal direction, and is then discharged in the forward direction. This direction is indicated by the arrow C as the paper feed direction.

As shown in FIG. 2, the thermal printer 10 includes a CPU 91 for controlling the motor 70 and the thermal heads 40 and 60, a ROM 92 in which a thermal printer control program is installed, a RAM (image buffer (IMGBUF)) 93 serving as a storage area in which image data 100 or the like is stored, a communication interface 94 for receiving a command from the host computer 110, a sensor 95 for detecting a position of the thermal paper 11, an ASIC 96, and the like. The CPU 91 functions as an adjustment part for adding blank data 103, 104, or a space area to image data 101, 102, and adjusting the readout order or the printing position of the image data 101, 102 by means of the firmware 97 to be described later.

The host computer 110 includes peripheral devices 116 such as a hard disk drive 113, keyboard 114, and display 115, and a processing section 125 for controlling these peripheral devices, and including an HDD controller 117, keyboard controller 118, graphic controller 119, an MPU 121, main memory 122, bridge 123, and communication interface 124.

As shown in FIG. 3, the thermal printer 10 includes firmware 97. The firmware 97 causes image data 100 to be received from the host computer 110, and causes blank data 103 corresponding to the distance between the first and second thermal heads to be added to the leading head 101*a* of the first image data 101 printed by the first thermal head 40. As a result of this, the difference in the printing start position caused by the difference between the thermal heads 40 and 60 in the mutual position is corrected.

The host computer 110 includes application software 111, and a printer driver 112. The application software 111 is a piece of software which operates on the OS of the host computer 110, and performs printing in accordance with the produced image data. When printing is performed, the application software 111 outputs data to the printer driver 112, thereby outputting data to the thermal printer 10. The printer driver 112 converts image data 100 output from the application software 111 into data that can be printed by the thermal printer 10, and transmits the converted image data to the thermal printer 10. At this time, the printer driver 112 designates whether the image data is image data for the front surface, i.e., the first image data 101, or image data for the back surface, i.e., the second image data 102 by using a command, and transmits the thus prepared data to the thermal printer 10.

Figure 4:
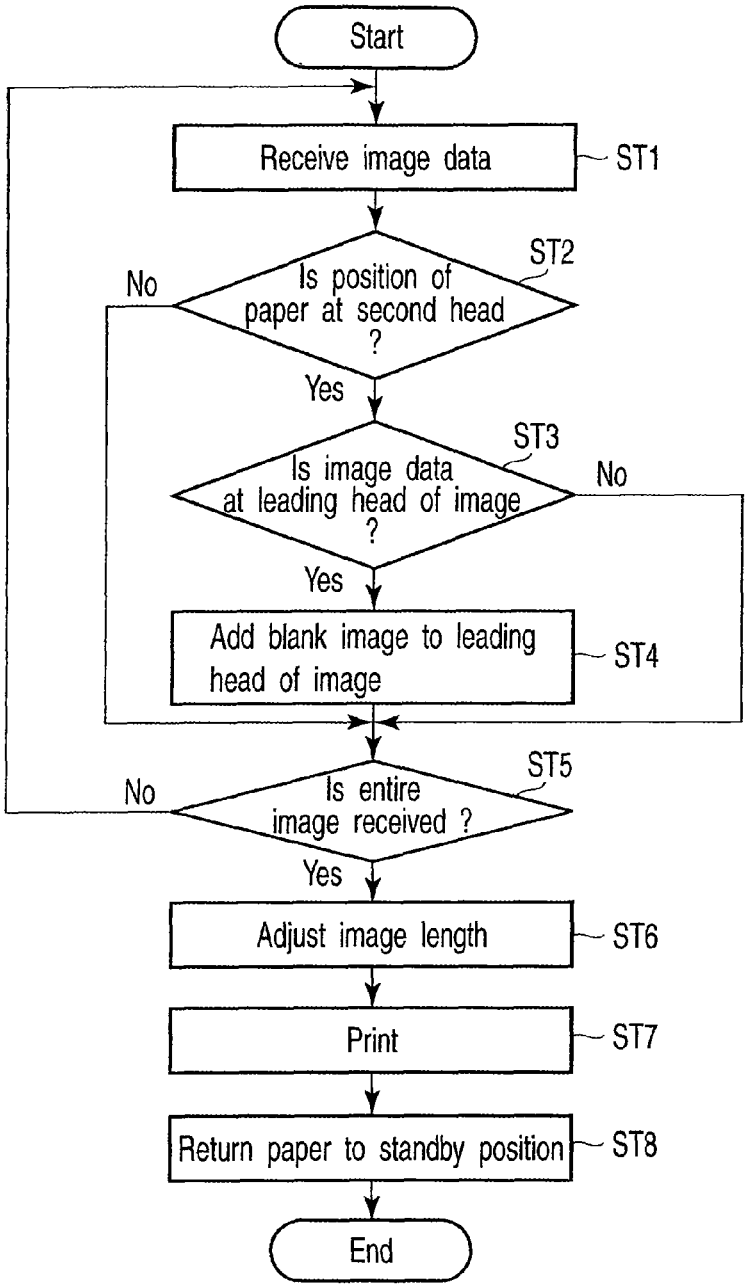
FIG. 4 is a flowchart showing a procedure for adjusting image data in a printing method according to the embodiment of the present invention.

Next, the printing method using the printer 1 according to this embodiment will be described below with reference to the flowchart of FIG. 4. Incidentally, here, when both side printing is performed, the feed start position of the thermal paper 11 is the position of the second thermal head on the upstream side.

After the image data 100 is specified by the command as to whether the data is the first image data 101 for the front surface or the second image data 102 for the back surface, the image data 100 is transmitted to and received by the thermal printer 10 (ST1).

Then, it is judged whether or not the waiting position of the thermal paper 11 is the predetermined position, for example, the position corresponding to the second thermal head (ST2). Further, it is judged whether or not the image data to be printed is at the leading head of the entire image data (ST3). When it is judged in steps ST2 and ST3 that the waiting position of the thermal paper 11 is at the position of the second thermal head, and that the image data is at the head, blank data 103 is added to the leading head of the first image data 101, as will be described later in detail (ST4). Details of the addition processing of the blank data 103 will be given later.

Incidentally, the feed start position of the thermal paper 11 is set at the position of the second thermal head on the upstream side as described above, and hence, if the waiting position is not the position of the second thermal head 60 in step ST2, it is assumed that the thermal paper 11 is already fed to the first thermal head 40 side at the downstream position, and the flow is advanced to step ST5 to be described later.

When the thermal printer 10 receives the entire image data 100 for the front and back surfaces, and receives a printing command (ST5), processing for adjusting the end of the image data of each of the both surfaces to make the print ending timings coincide with each other on both the surfaces is performed (ST6). Details of the adjustment will be given later.

After the length of the image data is adjusted, the motor 70 is driven, thereby simultaneously driving the first and second thermal heads, and performing the printing processing (ST7).

After the printing processing is completed, the thermal paper 11 is fed and returned to the position corresponding to the second thermal head 60 (ST8).

Figure 5:
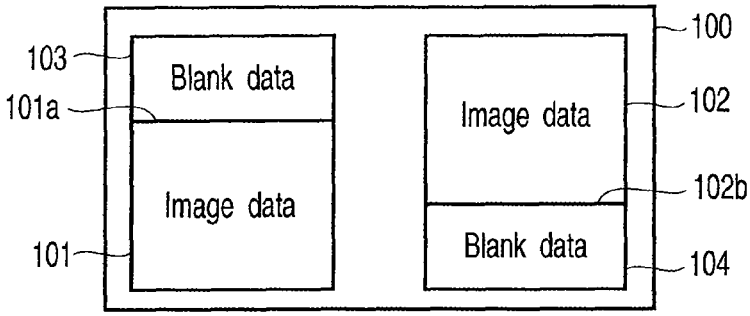
FIG. 5 is an explanatory view showing image data to be stored in a RAM in the embodiment of the present invention.

Next, the processing of adjusting the printing start position by adding blank data 103 to the head of the first image data 101 will be described below. FIG. 5 is a view schematically showing the image data 100 stored in the RAM 93. As described previously, the positions of the first thermal head 40 and the second thermal head 60 in the feed direction are different from each other, and hence, if both the thermal heads 40 and 60 start printing simultaneously, and the image data items 101 and 102 are printed, there occurs a difference in the printing start position between both the surfaces of the thermal paper 11, the difference corresponding to the difference between the heads.

In order to correct the difference, blank data 103 is added. That is, in step ST4 described above, before storing the first image data 101 in the RAM 93, blank data 103 corresponding to the difference between the positions of the thermal heads, i.e., blank data 103 that occupies the same length as the difference between the positions of the thermal heads when the blank data is printed is added to the head of the first image data 101. Incidentally, the value of the positional difference between the first thermal head 40 and the second thermal head 60 is held in advance in the firmware 97. By the addition of the blank data 103 or the space area, the readout order of the first image data 101 is shifted toward the end side. That is, when the printing by the first thermal head 40 is started, the blank data 103 is printed as a blank, whereby the printing start position on the front surface of the thermal paper 11 is adjusted so as to allow the start position to be shifted toward the end side.

Incidentally, when the image data 101 is stored in the RAM 93, if the data is cleared by null values, the first image data 101 may be stored in the RAM 93 with a space corresponding to the positional difference between the thermal heads secured in the RAM 93, in place of adding the blank data 103. That is, it is possible to adjust the printing start position by providing a space area to shift the first image data 101 toward the end side.

Next, the processing of adjusting the ends of both the image data items 101 and 102 will be described below. First, a length of the total of the first image data 101 and the added blank data 103 is compared with a length of the second image data 102, and a difference between the lengths is obtained. Blank data 104 corresponding to the obtained difference in length is added to the end of the shorter one of the two lengths of the length of the total of the image data 101 and the blank data 103, and the length of the second image data 102.

That is, the end position of the first image data 101, the head of which is shifted toward the end side, and the end position of the second image data 102 are compared with each other, and the blank data 104 is added to the end of the shorter length in accordance with the end position of the longer one, whereby the ends of the image data items corresponding to the first and second thermal heads 40 and 60 are made coincident with each other.

In FIG. 5, a case where the length of the first image data 101, and the length of the second image data 102 are equal to each other is exemplified. In this case, blank data having the same length as the blank data 103 added to the head is added to the end of the second image data.

Incidentally, when the total of the first image data 101 and the blank data 103, and the second image data 102 are of the same length, the blank data 104 is not added.

Further, when the second image data is longer than the total of the first image data 101 and the added blank data 103, blank data 104 corresponding to the difference in length is added to the end of the first image data 101.

Incidentally, the length of each of the image data items 100 to 104 mentioned herein implies the length occupied by each of the data items printed on the thermal paper 11, and it is assumed that if the lengths of the image data items are made equal to each other, the end positions of the image data items printed on the thermal paper 11 are lined up.

Incidentally, if the corresponding part of the RAM 93 is cleared by null values, a space corresponding to the positional difference between the thermal heads 40 and 60 may be secured in the RAM 93 to thereby set a space area, in place of adding the blank data 104.

Next, the operation to be performed in the printing processing will be described below. Here, the case where the lengths of the first image data 101 and the second image data 102 are equal to each other will be described.

As shown in FIG. 1, in the sate where the cover 21 is closed, when the first thermal head 40 is pressed against the first platen roller 30 by a first energizing part 42, the second thermal head 60 is pressed against the second platen roller 50 by a second energizing part 63, the idler gear 82 and the idler gear 85 are engaged with each other, and the thermal paper 11 is arranged in such a manner that the paper is passed through a part between the first thermal head 40 and the first platen roller 30, and a part between the second thermal head 60 and the second platen roller 50.

In this state, when the motor 70 is rotated, the output gear 72 is rotated in the direction indicated by an arrow R1, whereby the reduction gear 74 and the drive gear are rotated in the direction R2. As a result, the second platen gear 80 and the second platen roller 50 are rotated in the direction R3. Here, by the rotation of the second platen roller 50, the thermal paper 11 is moved to the left side obliquely toward the first thermal head 40 while being kept in contact with the second thermal head 60. At this time, the second thermosensitive layer of the other surface 14 of the thermal paper 11 can be printed by the second thermal head 60.

Further, by the rotation of the second platen gear 80, the idler gear 82 is rotated in the direction R4, and the idler gear 85 is rotated in the direction R5. As a result of this, the first platen gear 88 is rotated in the direction R6 together with the first platen shaft 34 and the first platen roller 30. By the rotation of the first platen roller 30 in the direction R6, the thermal paper 11 is advanced horizontally toward the left side in FIG. 1 while being kept in contact with the first thermal head 40. As a result of this, it is possible to print the first thermosensitive layer on one surface 13 of the thermal paper 11 by the first thermal head 40.

Figure 6:
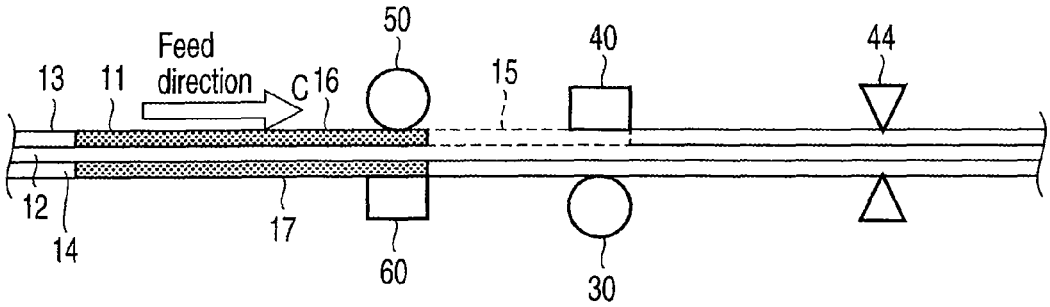
FIG. 6 is a side view showing a printing step in the printer according to the embodiment of the present invention.

Assuming that the thermal paper 11 is arranged at a position corresponding to the second thermal head 60, and is on standby there as shown in FIG. 6, printing is started from this position. When printing is started by using both the thermal heads 40 and 60, the first thermal head 40 voidly prints the added blank data 103 on the head part 15 of the thermal paper 11. That is, the first thermal head 40 is driven without actually printing on the printing paper. At this time, the second image data 102 is printed on the back surface 14 by the second thermal head 60.

Figure 7:
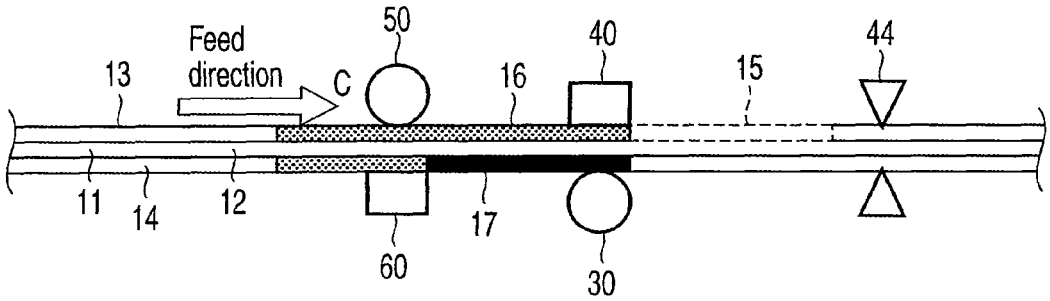
FIG. 7 is a side view showing a printing step in the printer according to the embodiment of the present invention.

After this, as shown in FIG. 7, the thermal paper 11 is fed, the printing processing is continued, and when the printing of the blank data 103 is ended, the first image data 101 is printed on the front surface 13 by the first thermal head. In FIGS. 6 to 9, the part on which the first image data 101 is to be printed is indicated by the printing position 16, and the part on which the second image data 102 is to be printed is indicated by the printing position 17. Incidentally, in the printing positions 16 and 17, the state before printing is indicated by the mesh as the anticipated printing part, and the state after printing is indicated by solid black.

Here, the blank data 103 corresponds to the value of the distance between the thermal heads, i.e., the positional difference between the thermal head 40 and the thermal head 60, and hence the head part of the printing position 16, on the front surface 13 i.e., the printing start position of the thermal paper 11, and the head part of the printing position, on the back surface 14 i.e., the printing start position, are lined up.

Figure 8:
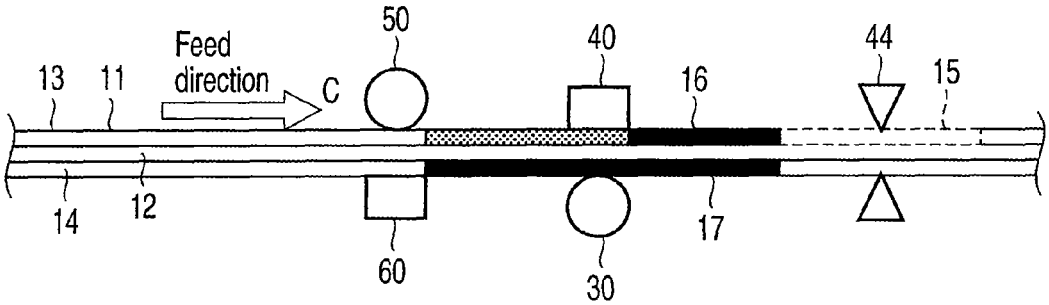
FIG. 8 is a side view showing a printing step in the printer according to the embodiment of the present invention.

Thereafter, when the thermal paper 11 is further fed, and the printing is continued, the printing processing of the second image data 102 performed by the second thermal head 60 is ended earlier, as shown in FIG. 8.

Figure 9:
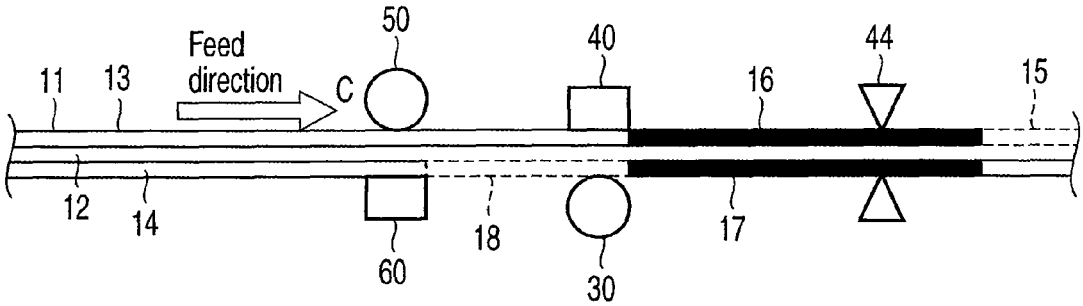
FIG. 9 is a side view showing a printing step in the printer according to the embodiment of the present invention.

After this, the second thermal head 60 prints the blank data 104 added to the end part 18 as shown in FIG. 9. That is, the second thermal head 60 is kept driven without actually printing on the printing paper. At this time, the first image data 101 is being printed by the first thermal head 40.

The end of the blank data 104, and the end of the first image data 101 are lined up, and hence simultaneously with the finish of the printing of the first image data 101 by the first thermal head 40, the printing of the blank data 104 is finished by the second thermal head 60. Here, the printing processing operations of both the thermal heads 40 and 60 are simultaneously completed.

According to the printing processing described above, the first and second thermal heads 40 and 60 are simultaneously started, and are simultaneously ended, while the starting parts of the printing positions 16 and 17 are lined up. Furthermore, in this case, the lengths of the first and second image data items 101 and 102 are equal to each other, and hence the ending positions of the printing positions 16 and 17 are also lined up.

According to the printer 1 and the printing method of this embodiment, the following effects can be obtained. That is, by adding the blank data 103 to the leading head of the first image data 101, it becomes possible to prevent a difference between both the surfaces of the thermal paper in the printing start position resulting from the positional difference between the two thermal heads 40 and 60 from occurring without complicating the algorithm. Further, by adding the blank data 104 to the end, it becomes possible to make the printing end timings on both the surfaces of the thermal paper coincide with each other. Further, the adjustments are performed on the thermal printer 10 side, and hence it becomes unnecessary for the host computer 110 side to consider the difference between both the surfaces of the thermal paper resulting from the positional difference between the thermal heads 40 and 60. Accordingly, the algorithm of the printing control can be simplified.

Incidentally, the present invention is not limited to the above embodiments, and the configurations can be appropriately modified and implemented. Further, by appropriately combining a plurality of constituent elements disclosed in the embodiments, various inventions can be formed. For example, some of the constituent elements may be deleted from all the constituent elements shown in the embodiments. Further, constituent elements of different embodiments may be combined with each other.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A printer for printing on one surface and the other surface of a sheet-like printing medium fed in a predetermined feed direction, comprising:

a first printing part provided in the feed direction, for printing on the one surface;

a second printing part provided on the upstream side of the first printing part in the feed direction, driven simultaneously with the first printing part, for printing on the other surface;

a storage area, in which first image data corresponding to the first printing part and second image data corresponding to the second printing part are stored; and an adjustment part for adjusting printing start positions of printing operations performed by the first and second printing parts by shifting the readout order of the first image data to be stored in the storage area toward the end side by adding blank data or a space area to a leading head part of the first image data in accordance with a positional difference between the first printing part and the second printing part in the feed direction so as to cause the first printing part and the second printing part to start printing simultaneously.

2. The printer according to claim 1, wherein the ends of the first and second image data items are made coincident with each other by adding blank data or a space area to the end of the first or second image data in accordance with a difference between the readout order of the end of the first image data shifted toward the end side, and the readout order of the end of the second image data.

3. A printing method for feeding a sheet-like printing medium in a predetermined feed direction, and performing printing processing on one surface and the other surface of the printing medium, comprising:

receiving first image data to be printed on the one surface, and second image data to be printed on the other surface; and adjusting printing start positions on the printing medium by shifting the readout order of the first image data to be stored in a storage area toward the end side by adding blank data or a space area to a leading head part of the first image data in accordance with a positional difference in the feed direction between a first printing part provided in the feed direction, for printing on the one surface, and a second printing part provided on the upstream side of the first printing part in the feed direction, driven simultaneously with the first printing part, for printing on the other surface so as to cause the first printing part and the second printing part to start printing simultaneously.

4. The printing method according to claim 3, wherein the adjustment of the printing start positions is performed when the position of the second printing part corresponds to the head of a part of the printing medium to be printed, after the first and second image data items are received, the ends of the first and second image data items are made coincident with each other by adding blank data or a space area to the end of the first or second image data in accordance with a difference between the readout order of the end of the first image data shifted toward the end side, and the readout order of the end of the second image data, and the first and second printing parts are simultaneously driven, thereby performing the printing processing.

* * * * *